United States Patent [19]

Weglin

[11] Patent Number: 4,559,715

[45] Date of Patent: Dec. 24, 1985

[54] DRAFTING MACHINE

[76] Inventor: Walter Weglin, 945 Sunset La., Bellevue, Wash. 98004

[21] Appl. No.: 616,825

[22] PCT Filed: Sep. 29, 1983

[86] PCT No.: PCT/US83/01553

§ 371 Date: May 14, 1984

§ 102(e) Date: May 14, 1984

[87] PCT Pub. No.: WO84/01330

PCT Pub. Date: Apr. 12, 1984

Related U.S. Application Data

[63] Continuation-in-part of Ser. No. 428,726, Sep. 30, 1982, Pat. No. 4,438,569.

[51] Int. Cl.[4] ..... B43L 13/00

[52] U.S. Cl. ..... 33/438

[58] Field of Search ..... 33/436, 437, 438

[56] References Cited

U.S. PATENT DOCUMENTS 4,438,569 3/1984 Weglin ..... 33/438

4,486,956 12/1984 Bruneau ..... 33/438

4,486,957 12/1984 Otten ..... 33/438

*Primary Examiner*—Robert I. Smith

*Attorney, Agent, or Firm*—Seed and Berry

[57] ABSTRACT

A drafting machine has fixed parallel top and bottom rails (R-1,R-2) and a center rail (R-3) which is movable perpendicularly along the fixed rails and has a carriage (4) carrying a protractor head (6) which in turn carries a straight edge assembly (2) including two mounting bars (30,40) perpendicular to one another and each having a reference scale (52) and an adjustable scale (54). The mounting bar (40) is movable along the mounting bar (30) and has an X-axis straight edge (64). A Y-axis straight edge (62) is movable along the mounting bar (40). Fine adjustment mechanisms (80) are provided on the center rail (R-3), the carriage (4), the mounting bar (40), and the Y-axis straight edge (62), which operate with racks (144,145) along the top and bottom rails (R-1,R-2), a rack (152) on the center rail (R-3), and racks (84) on the mounting bars (30,40). The fine adjustment mechanisms (80) may be readily disengaged.

9 Claims, 19 Drawing Figures

DRAFTING MACHINE

This application is a continuation-in-part of my copending application Ser. No. 428,726, filed Sept. 30, 1982, now U.S. Pat. No. 4,438,569, issued Mar. 27, 1984.

TECHNICAL FIELD

This invention relates to drafting equipment, and more particularly, to a drafting machine having fine adjustment of the protractor head along both axes and fine adjustment of straight edges relative to removable scales thereon.

BACKGROUND ART

Architectural or engineering plans are normally prepared on paper secured to a drafting table. A drafting table comprises a relatively large, flat, smooth drawing surface which can be inclined to suit the preferance of the individual draftsperson. Although drafting tables are usually inclined at some angle between vertical and horizontal when in use, directions will be referred to herein as if the tables were positioned vertically.

Preparing architectural or engineering drawings often requires that objects be located with respect to a vertical and horizontal axis and drawn with as much speed and accuracy as possible. Measuring instruments known as "scales" are used to position dots to accurately mark off distances along a horizontal or vertical axis. Once distances are marked off with dots using a scale, straight lines are drawn through the dot marks with the aid of a straight edge.

Drafting machines are devices which are attached to a drafting table to aid a draftsperson in preparing an architectural or engineering drawing. They combine the functions of a parallel ruler, protractor, scale and triangle. A conventional drafting machine includes a pair of straight edges mounted perpendicularly to one another. These straight edges lie flat against the drafting table and are rotatably mounted on a protractor head. A movable arm assembly is mounted on the table to support the protractor head. The majority of drafting machines are constructed so that the protractor head may be moved over the surface of the table without change in orientation by using one of two types of movable arm assemblies. The first type is not lockable and utilizes a parallel motion linkage comprising two sets of double bars with an intermediate elbow joint. The second type, which is lockable, utilizes a vertical arm which spans the height of the table and is slidably mounted on rails at the top and bottom of the table for horizontal movement and has a locking means. Relatively short horizontal and vertical straight edge scales are attached to a protractor head which is slidably attached for vertical movement to the vertical arm and has a locking means. By using the vertical arm to move the protractor head across the board, moving the protractor head along the vertical arm, and rotating the protractor head and positioning it in accordance with angular indicia marked thereon, the draftsperson can position the straight edges at desired angles with respect to the vertical and horizontal at most locations on the table.

When preparing drawings with a conventional drafting machine, a several-step process is required to locate and draw objects. Initially, horizontal and vertical reference lines are made with light pencil. A scale is then placed adjacent the reference line and dots are placed on the reference line to mark off coordinates corresponding to dimensions on the object being drawn. Once coordinates have been marked off on the reference lines, the straight edges of the drafting machine can be used to draw lines through these points on the drawing. These points may correspond, for example, to the center of a circle, the terminus of an arc, the intersection of two lines, or the end points of a line parallel to the reference lines. Scales may again be used to mark off points on such parallel lines.

Although the process described above allows a draftsperson to complete a drawing more quickly and accurately than without the aid of a conventional drafting machine, several undesirable aspects remain with such a procedure. Marking off points with a scale is a relatively slow process which is susceptible to inaccuracies. When marking off the coordinates on reference lines, for example, dots may not be accurately placed. When the straight edges are placed adjacent such dots in order to draw lines through the dots on the drawing, an additional error may occur. Additional inaccuracies may be introduced by improper reading of the scale. When marking fractional or decimal dimensions (e.g., 12 53/64 or 12.828 inches), it is often necessary to read closely spaced gradations, and errors may occur. Additionally, because the smallest gradations on architectural scales are marked only on one end of the scale rather than along its entire length, marking off two successive fractional dimensions can be either time-consuming or inaccurate. For example, to mark off a 1-foot, 5-inch line starting 1 foot-2½ inches from a given point using a conventional scale, it is necessary either to add the two dimensions together (consuming extra time) or measure the second distance (i.e., 1 foot 5 inches) from the first distance, a procedure which will result in compounding any error which may occur in the first measurement.

DISCLOSURE OF THE INVENTION

It is an object of this invention is to provide a drafting machine which will allow a draftsperson to accurately and quickly locate and mark points on an engineering or architectural drawing.

Another object of the invention is to provide a drafting machine which allows the drawing of precisely located lines without the necessity of using locating dots or marks on the drawing.

A further object of this invention is to provide a drafting machine which will allow objects to be precisely and quickly located and drawn without the aid of separate scales.

Still another object of the invention to provide a drafting machine which will permit easy and accurate measurement of fractional or decimal distances.

A further object is to provide a drafting machine with a fine adjustment-locking means for both horizontal and vertical straight edges without necessitating the movement of the heavier transport elements of the drafting system; i.e., the parallel motion linkage elbow joint arms or vertical arm.

It is also an object to provide a fine adjustment-locking means which can be used on the type of drafting machine having a vertical arm and provide for fine adjustment and setting of the location of the protractor head and zero-zero point of the straight edge assembly carried by the protractor head.

Another object of this invention is to provide a drafting machine which will allow accurate measurement of distances along an angle.

An additional object is to provide a drafting machine which can readily be used for plotting graphs.

A further object is to provide a drafting machine having readily interchangeable scales integral therewith which can be easily read by a user of the drafting machine.

Another object is to provide a drafting machine with a fine adjustment-locking means for both horizontal and vertical straight edges including measuring scales so located as to be readily readable in the immediate drawing area.

A still further important object is to provide an improved transport system for the protractor head which will accurately position it and maintain the selected position, and also be easy to use.

These and other objects, which will become more apparent as the invention is more fully described below, are obtained by providing a drafting machine having a straight edge assembly including a pair of straight edges mounted perpendicularly to one another. Each straight edge is slidable and alignable with respect to a scale which is integral with the drafting machine to permit the user to draw lines at measured distances without first marking off the distances with a separate scale. The slidable straight edges abut one another closely enough to permit the drawing of a small continuous right-angle mark to locate alignment points precisely on a drawing or graph.

Each straight edge is connected to a slidable housing which is movable along a guide rod on a mounting bar on which at least one scale is removably mounted. A viewing window, preferably equipped with a magnifying lens, is positioned within the housing to allow viewing of the scales through the slidable housing. Fine adjustment assemblies within the slidable housings allow incremental movement of the straight edges with respect to the measuring scales. A worm gear and spur gear combination within each fine adjustment assembly locks the assembly to a rack and also moves the assembly along the rack located on the side of each mounting bar in response to rotation of an adjustment knob. An override mechanism can be activated to isolate the gear combination from the rack and allow the slidable housing to slide freely along the guide rods and measuring scales. The surfaces of the slidable housing, which slide along the mounting bar to prevent rotation of the slidable housing during movement, are preferably coated with synthetic fluorene-containing resin material, such as Teflon or other similar materials, for reduced friction sliding.

An adjustable scale and a reference scale are preferably removably mounted on each mounting bar. An adjustment mechanism allows the adjustable scales to move with respect to the reference scales, thereby allowing the user to position a starting point for a measurement at an integer reading on the adjustable scales. A point located a fractional distance away from such starting point may then be easily located by simply moving the slidable housing and straight edge into alignment with a point on the scales which is the sum of the integer and the fractional distance desired. The scales are preferably formed of metallic material so that magnets positioned within the mounting bars can hold the scales securely against the mounting bars.

BEST MODE FOR CARRYING OUT THE INVENTION

Figure 1:
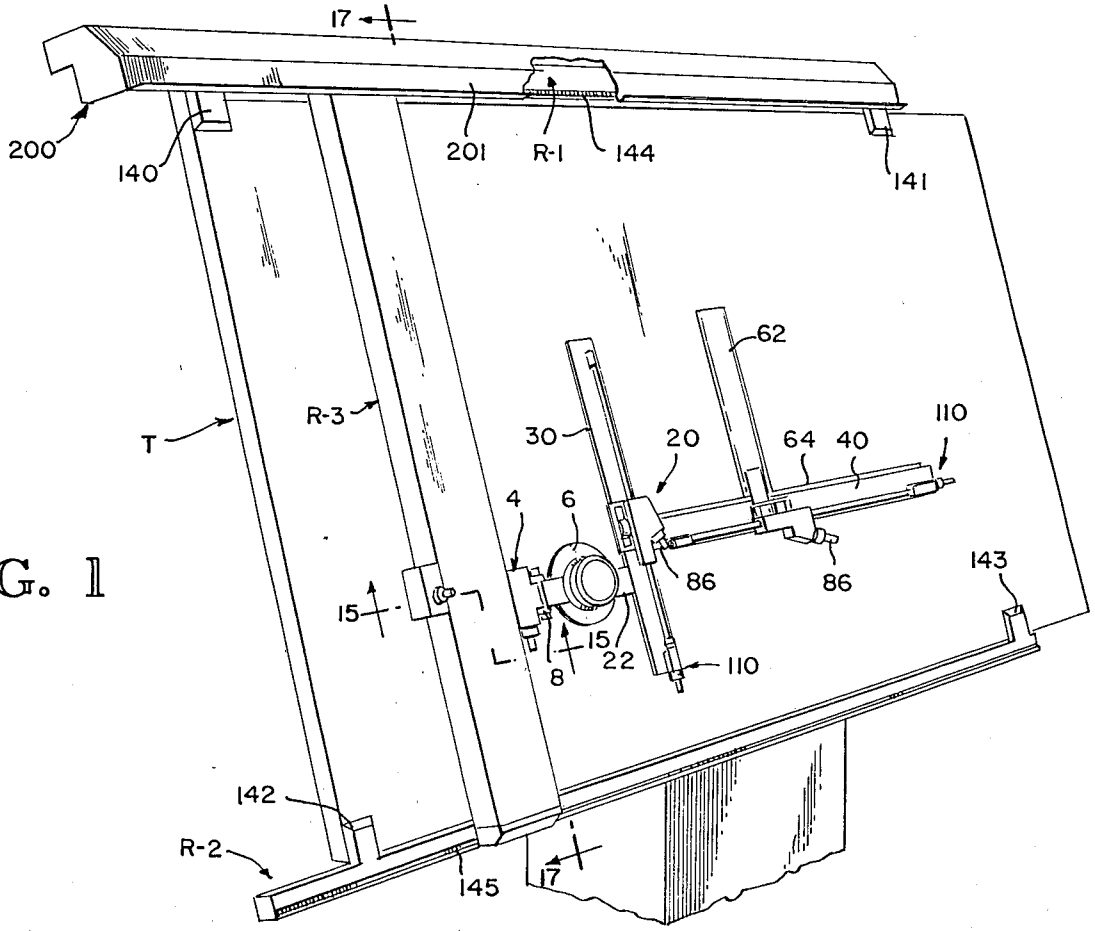
FIG. 1 is a isometric view of a drafting table with one embodiment of the drafting machine of this invention mounted thereon.

The general layout of a preferred embodiment of the drafting machine of this invention is illustrated in FIG. 1. The drafting machine has top and bottom rails R-1, R-2 secured to a drafting table T as by clamping. A vertical central arm or rail R-3 is slidably mounted on the rails R-1, R-2 for horizontal movement, and a relatively short horizontal arm provided by a carriage 4 on the rail R-3 supports a protractor head 6 and straight edge assembly 20. The carriage arm 4 is preferably hingedly connected to the protractor head 6 by a link 8 having pin connections 10 and 12 with the carriage and protractor head. The straight edge assembly 20 includes a short mounting arm 22 which is rotatably mounted to the protractor head 6 at its inner end and is adjustably secured to the remainder of the straight edge assembly 20 at its outer end. The protractor head 6 is conventional in being adjustable to either restrict or permit rotation of the mounting arm 22 relative to the center rail R-3, as desired, and can be locked in selected position.

Figures 2, 3:
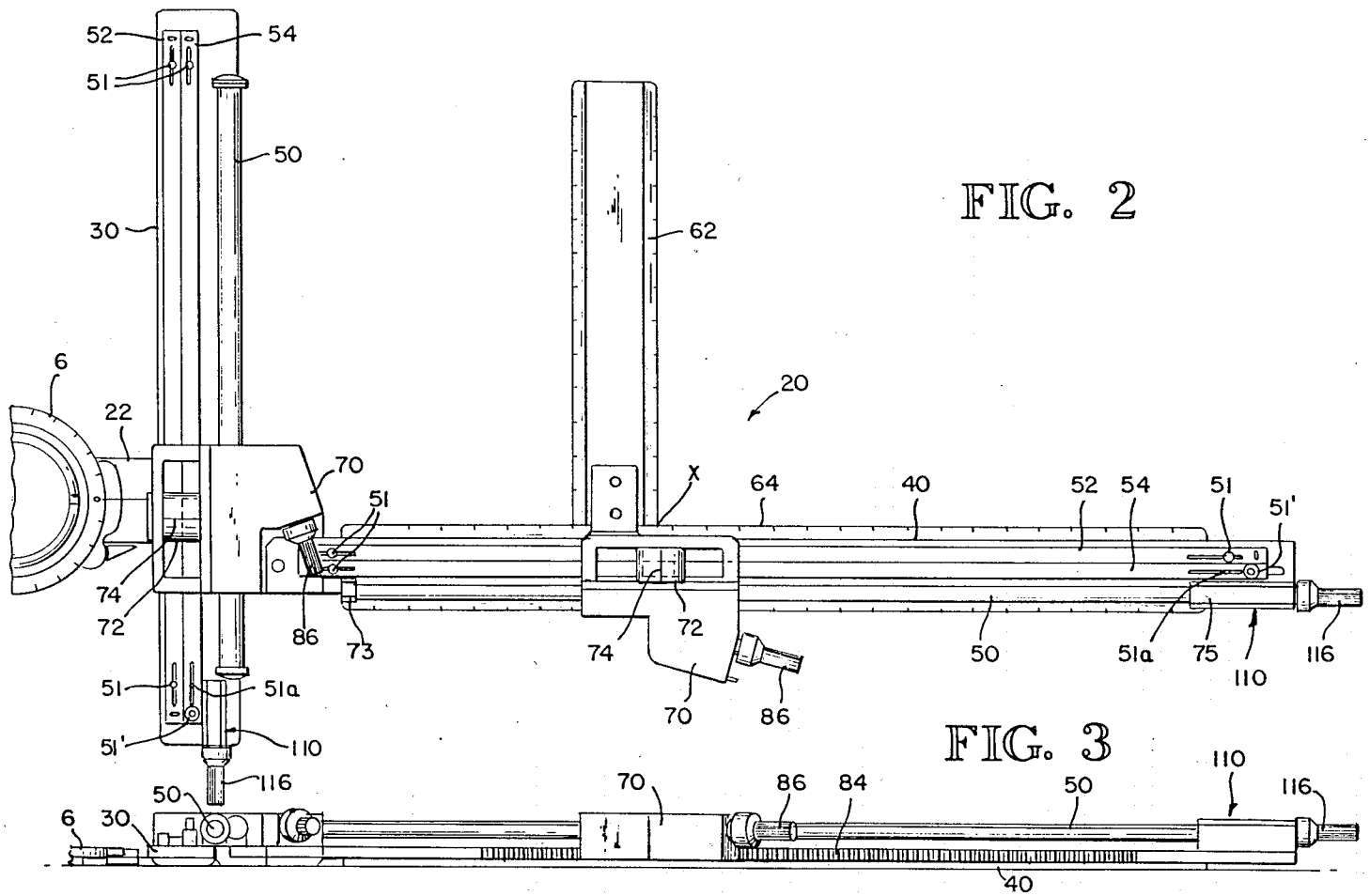
FIG. 2 is a top plan view of a preferred embodiment of the drafting machine of this invention cut away at the protractor head to illustrate the straight edge assembly.
FIG. 3 is a top elevation view of the straight edge assembly.
Figures 4, 5, 6, 7:
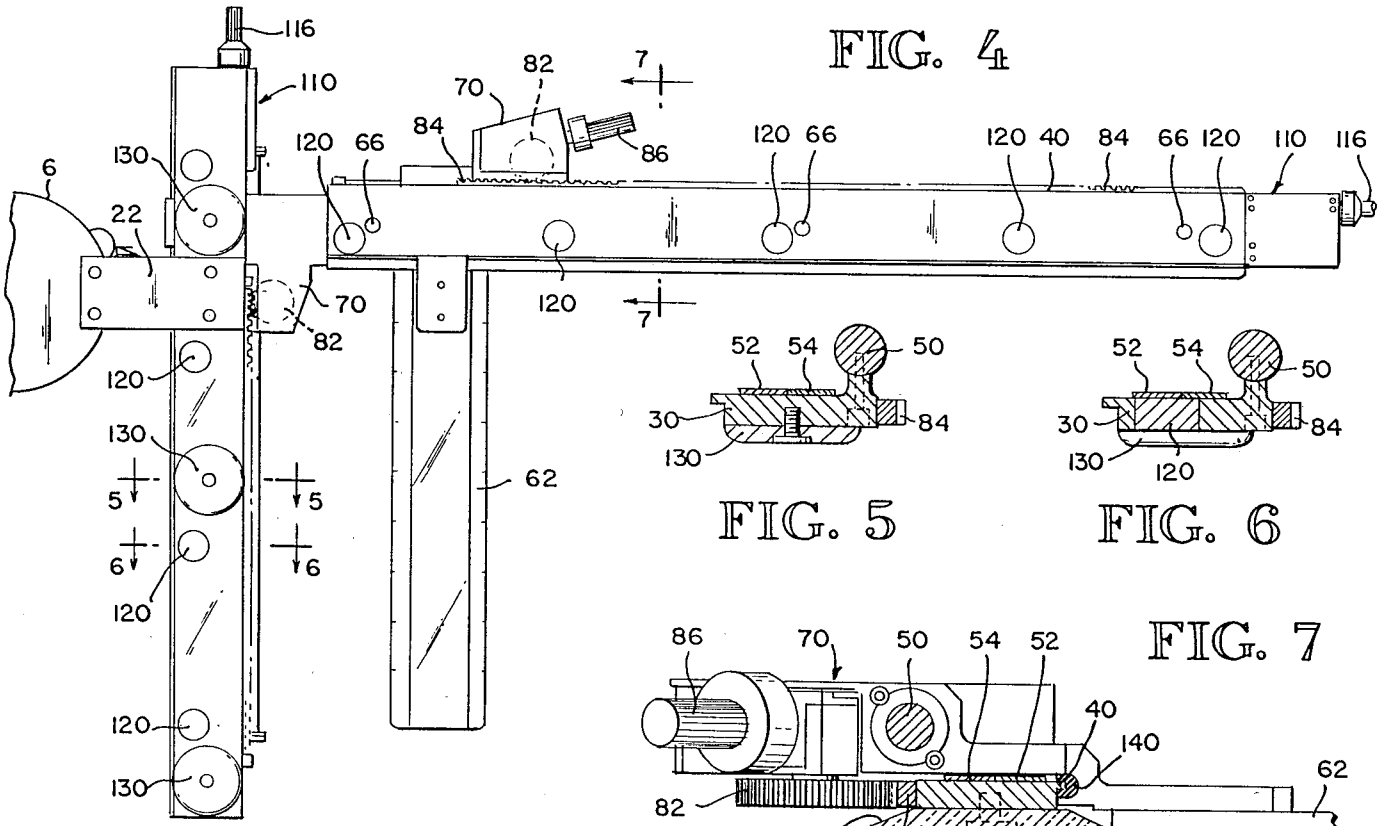
FIG. 4 is a bottom plan view of a the straight edge assembly.
FIG. 5 is a cross-sectional view taken through line 5—5 of FIG. 4.
FIG. 6 is a cross-sectional view taken through line 6—6 of FIG. 4.
FIG. 7 is a cross-sectional view taken (cover removed) through line 7—7 of FIG. 4.

The straight edge assembly 20 includes a vertical mounting bar 30 which is adjustably mounted on the outer end of the mounting arm 22 and a horizontal mounting bar 40 which is slidably attached to the vertical mounting bar 30 in an adjustably perpendicular arrangement, as seen in FIG. 2. Housings 70 are slidably mounted on guide rods 50 and extend perpendicularly from respective of the mounting bars 30,40. The horizontal straight edge 64 is mounted on the back side of the horizontal mounting bar 40 and held in place by fasteners 66, as seen in FIGS. 4 and 7. Thus, the slidable housing 70 mounted on the vertical guide rod 50 supports both the horizontal mounting bar 40 and corresponding straight edge 64.

Each mounting bar 30,40 preferably includes a reference scale 52 and an adjustable scale 54 which are removably mounted lengthwise on the top face of the mounting bars 30,40. A viewing window within each slidable housing 70 allows the user of the drafting machine to read the position of the sliding housing 70 (and consequently, the straight 62,64) with respect to the scales. A hairline 74 is preferably positioned on a magnifying lens 72 in the viewing window and aligned with the drawing edge of each straight edge 62,64 to facilitate positioning the straight edge at a desired scale reading.

Unlike conventional drafting machines wherein the straight edges usually do not contact one another, the straight edges 62,64 of the drafting machine 10 abut one another at their respective alignment points, as indicated by reference letter X in FIG. 2. By providing abutting surfaces aligned with hairlines 74, the drafting machine 10 enables a draftsperson to quickly and accurately mark points by drawing a small right angle along the abutting surfaces. This feature is especially helpful when plotting graphs using plotting scales, as described below.

The position of each straight edge 62,64 may be varied by using a fine adjustment mechanism 80 or by overriding the fine adjustment mechanism 80 and sliding the housing freely along the measuring scales 52,54.

Figure 8:
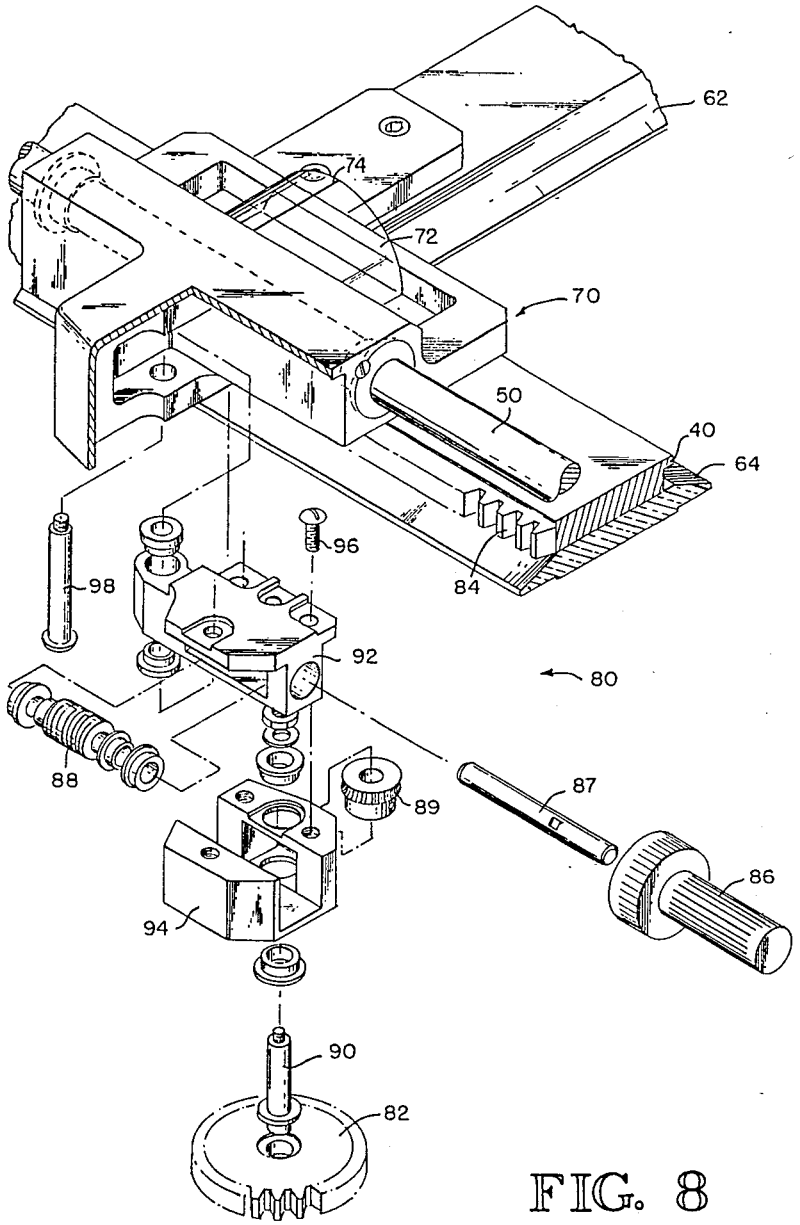
FIG. 8 is an exploded view of the slidable housing and fine adjustment assembly.
Figure 9:
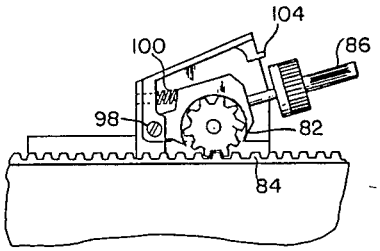
FIG. 9 is a bottom plan view (cover removed) of the fine adjustment assembly shown with the spur gear engaging the rack.
Figure 10:
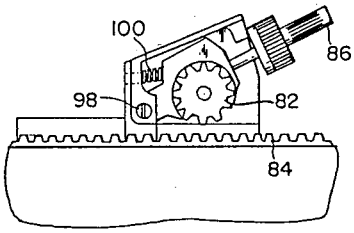
FIG. 10 is a bottom plan view (cover removed) of the fine adjustment assembly with the override mechanism activated.
Figure 11:
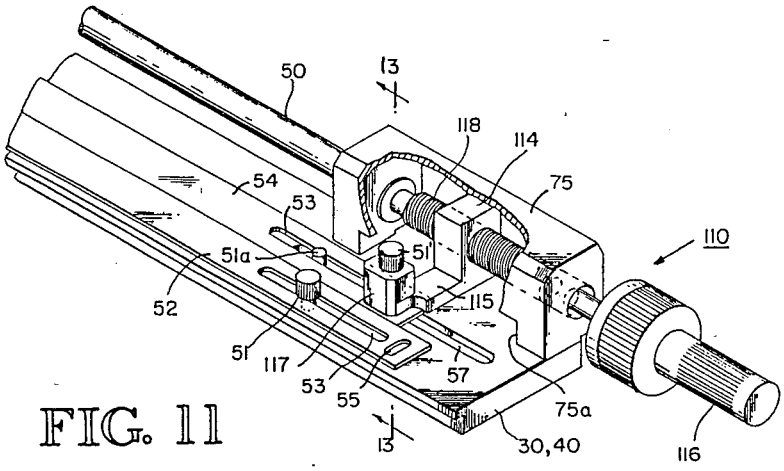
FIG. 11 is an isometric view of the scale adjustment assembly cut away to show the traveling nut.

The fine adjustment mechanism 80 is located within the slidable housing 70. It operates by rotating a spur gear 82 along a rack 84 to move the slidable housing along the guide rod 50. As best seen in FIG. 8, the fine adjustment mechanism 80 includes an adjustment knob 86 which is mounted on a common axle 87 with worm 88. Worm 88 meshes with worm gear 89, which is mounted on a common axle 90 with spur gear 82 to rotatably couple the adjustment knob 86 to the spur gear 82. As illustrated in FIG. 8, a first axle housing 92 and a second axle housing 94 are held together by fasteners 96. The axle housings 92,94 are pivotally mounted as a housing or frame unit within the slidable housing 70 by fastener 98, as seen in FIGS. 8, 9 and 10.

To operate the fine adjustment mechanism 80, the user of the drafting machine 10 need only rotate the adjustment knob 86. As seen in FIG. 9, spring 100 biases the pivotally mounted fine adjustment mechanism 80 so that gear 82 thereof is urged into contact with rack 84. The rotation of the adjustment knob 86 will cause the spur gear 82 to rotate, thereby moving the slidable housing 70 along the measuring scales 52,54. Guide rods 50, which extend lengthwise above the measuring bars 30,40, pass through a passageway in the slidable housing 70 as the slidable housing 70 moves along the measuring scales 52,54. These guide rods are supported at their ends on brackets 73,75. Each slidable housing 70 slidably engages its corresponding mounting bar 30,40, as shown in FIG. 7 to prevent rotation of the housing. A synthetic coating layer 140 is preferably mounted on the surfaces of the slidable housing 70, which directly engage the mounting bar 30,40 to reduce friction during sliding. The synthetic layer is preferably comprised of fluorene-containing resin material, such as Teflon, although other similar low-friction coatings could be used, and substitution of such materials will be obvious to those of ordinary skill in the art. It is preferred to provide ball bearing-type precision linear bearing units as bushings in the housings for rolling engagement with the guide rods 50 to eliminate any play as the housings move along the rods.

Figure 12:
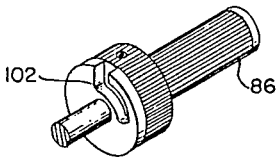
FIG. 12 is an isometric view of the adjustment knob of the fine adjustment assembly.

An alternate means for moving the slidable housings 70 and attached straight edges 62,64 along the measuring scales 52,54 is available by overriding the fine adjustment mechanism 80. The fine adjustment mechanism 80 may be pivoted away from the rack 84 by pushing the adjustment knob 86 away from the rack 84 and compressing spring 100, as shown in FIG. 10. A slot 102 positioned in the adjustment knob 86 of the fine adjustment mechanism 80 (see FIG. 12) receives peg 104 to isolate spur gear 82 from rack 84, thereby overriding the fine adjustment mechanism. Once the fine adjustment mechanism 80 has been overridden, the user of the drafting machine 10 can slide the straight edges 62,64 along the measuring scales 52,54 by merely pushing the respective slidable housing 70 in the desired direction.

Figure 13:
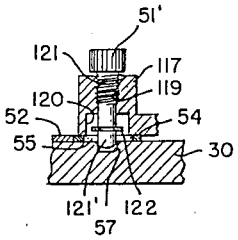
FIG. 13 is a detail sectional view taken on line 13—13 of FIG. 11.

In addition to providing a mechanism for adjusting the position of the straight edges 62,64 with respect to the mounting bars 30,40, the drafting machine 10 also includes a scale adjustment mechanism 110 partially housed in the bracket 75. In this regard, the scales 52,54 are removably mounted on the mounting bars 30,40 by threaded dowels **51*a* projecting through longitudinal slots 53 in the scales. Cap nuts 51 are provided for the dowels 51*a* of the scales 52 for clamping them in selected longitudinal positions. The scales 52,54 also have transverse slots 55 at their ends. Only the transverse slots 55 at the ends of the scales 54 located adjacent the brackets 75 are used, as will now be described. The scale adjusting mechanism 110 includes a traveling nut 114 which is movable lengthwise of a slide chamber in the bracket 74. This chamber has a slot 75*a* therealong for passage of an extension arm 115 connecting the nut 114 with a traveler 117. This traveler has a threaded bore 119 (FIG. 13) extending to a counter-bore 120 facing the scale 54. A screw 121 with a head 51' is received in the bore 119 and has a non-threaded extension 121' projecting through the transverse slot 55 into a longitudinal groove 57 in the respective underlying member 30,40. The extension 121' is preferably circumferentially grooved to receive a keeper 122 in the form of a snap-ring. The location of the adjustable scales 54 with respect to the reference scales 52 may be varied by rotating a respective scale adjustment knob 116, which is coupled to the traveling nut 114 by a jack screw 118 retained at its ends. The scale adjustment mechanism 110 allows the user of the drafting machine 10 to position the adjustable scales 54 so that an integer reading on the adjustable scales 54 is aligned with a known point on reference scale 52**. This alignment capability permits quick and accurate measurement of distances from that known point.

To remove an adjusting scale 54, the captivating screw 121 is backed off and then the scale is shifted endwise from beneath the traveler 117. The scale is flexible enough to then be bent outwardly and moved endwise over the head 51' of the captivated screw 121.

"Plotting scales" may be installed as reference scales 52 to facilitate plotting graphs with the drafting machine 10. Plotting scales are scales which, rather than ascending numerically from left to right as do conventional scales, have a zero point in the center with a negative scale to the left of center and a positive scale to the right of center. When plotting scales are installed on each mounting bar 30,40, the straight edges 62,64 can be easily moved around the resulting four quadrants for quickly plotting graphs.

The reference scales 52 and adjustable scales 54 are preferably fabricated of metallic material so that magnets 120 mounted within the mounting bars 30,40 will hold the scales 52,54 flat against the mounting bars 30,40 during use. The vertical mounting bar includes circular spacers 130 mounted on the back side thereof, as shown in FIG. 5. The thickness of the circular spacers 130 is approximately equal to the thickness of the straight edge 64 under the horizontal mounting bar 40 to ensure that both mounting bars 30,40 will rest approximately the same distance from the surface of the drafting table T.

It will be appreciated that the sight glass can be a magnifying lens and that the sight glass can be elongated and provided with a vernier scale for even more precise measurements.

As part of the present invention, there is provided an improved mechanism for precisely positioning the protractor head 6 relative to the table T, thereby making it possible to precisely position the zero reading point of the straight edge assembly 20 when desired, regardless of the angular setting of the protractor head. This mechanism will now be described.

The top and bottom rails R-1, R-2 are connected to respective pairs of C-clamps 140-141 and 142-143, which are adjusted to clamp the rails to the drafting table T so that the rails are parallel and spaced outwardly from the upper and lower edges of the table, respectively. Screw-mounted top and bottom gear racks 144, 145 are presented by the racks R-1, R-2 in parallel relation to face upwardly away from the surface of the drafting table. Meshing with these racks are respective top and bottom adjustable idler spur gears 146, 147 journaled at the ends of the center slide rail R-3. These gears are driven by drivers 148, 149, mounted on the ends of a shaft 150 running the length of the center rail, and this shaft 150 is in turn rotated by operation of an adjustment mechanism **80*a* located at the left side of the center rail. The function of the racks 144, 145 and associated adjustment mechanism is to adjust the position of the center rail R-3 longitudinally of the top and bottom rails R-1, R-2, i.e., along the X-axis. Adjustment of the straight edge assembly 20 along the Y-axis is accomplished by another adjustment mechanism 80*b* located at the right side of the center rail R-3 which operates with another rack 152 (FIG. 15) running the length of the center rail and facing downwardly toward the drafting table. As will later be described in greater detail, the adjustment mechanisms 80*a*, 80*b* operate in substantially the same manner as the previously described adjustment mechanism 80**.

The top, bottom and center rails are preferably extruded aluminum sections. Directing attention to the transverse cross-section of the center rail R-3 (FIG. 15), it is seen that the rail has a center slideway 154 joined at its left and right lateral sides by a pair of tracks 156L and 156R. To the left of the track 156L the center rail is formed with a longitudinal shaftway 158 for the shaft 150. Along its right side the center rail has a lower L-shaped flange forming a track 160 and has a generally T-shaped upper extension providing a support leg 162 with a concave lower edge face against which a guide shaft 164 is seated. This shaft extends the length of the center rail, and by way of a pair of open-type ball bushings 166 on the shaft, slidably supports the slide arm carriage 4, which carries the straight edge assembly 20 via the protractor head 6. The bushings 166 seat in a generally U-shaped housing 168 open at the top to clear the bushings and the shaft 164. At its right side, the housing 168 has a split **168*a* from the upper side and is provided with a pair of set screws 170 which force the inner part of the split portion of the housing against the right side of the bushings 166 to clamp the bushings against the shaft 164 so as to eliminate any play between the bushings and the shaft. At its underside, the housing 168 carries a pair of upper and lower rollers 171 which are adjusted to track respectively against the right- and left-hand faces of the track 160 so as to resist the downward movement exerted by the weight of the straight edge assembly 20**.

Figure 14:
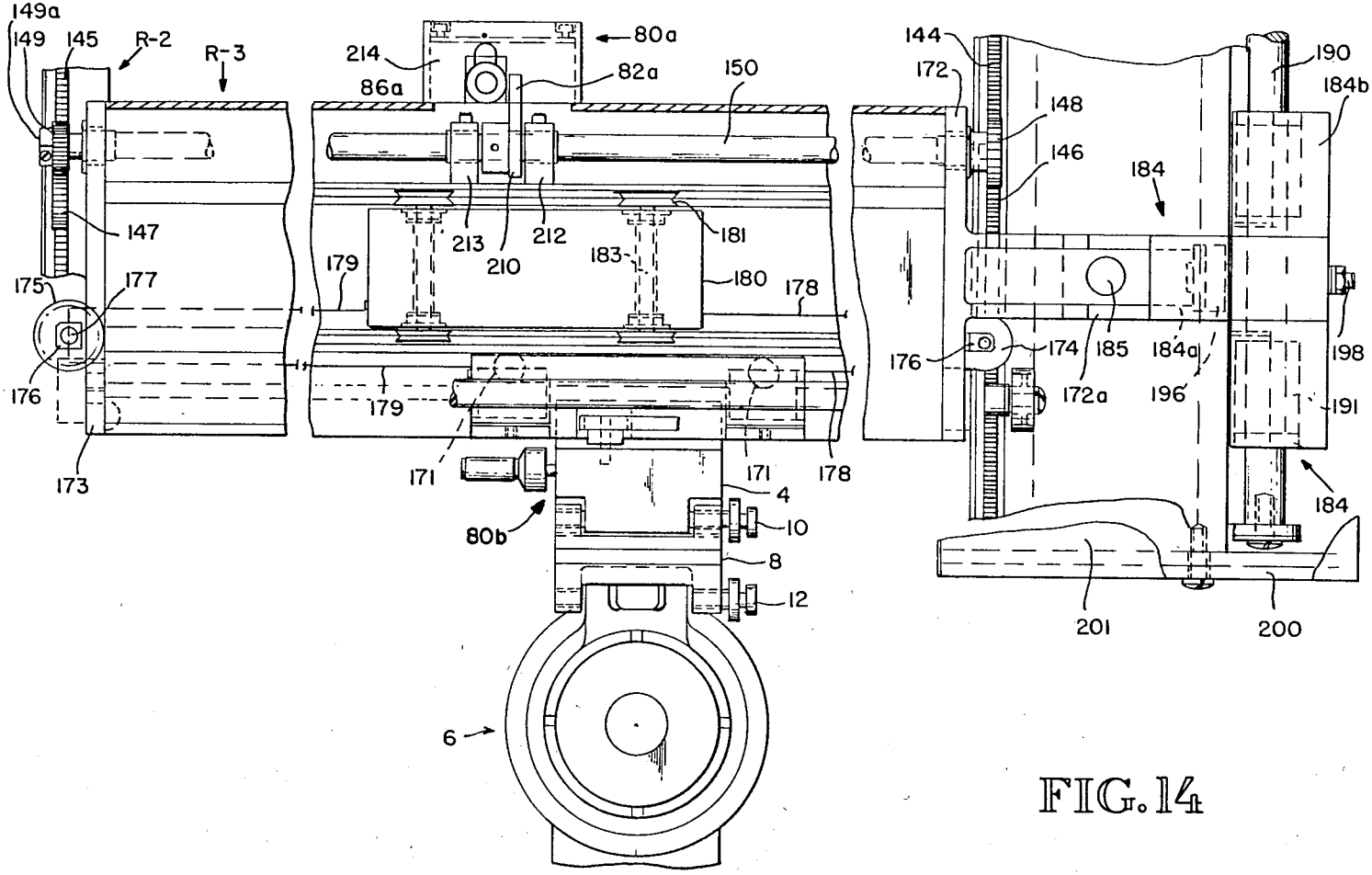
FIG. 14 is a fragmentary top plan view of the center rail assembly and related portions of the top and bottom rail assemblies with upper portions broken away.

Directing attention to FIG. 14, the center rail R-3 is closed at its ends by top and bottom end plates 172, 173 on which are mounted a pair of sheaves 174, 175 by way of two pairs of L-shaped mounting brackets 176. The end plates 172, 173 are slotted so that the sheaves are partially housed therein, and the pairs of brackets 176 are screw-mounted in the outer faces of the end plates to support shafts 177 for the sheaves. Passing around the sheaves 174, 175 are cables 178, 179 which are connected at one end to respective ends of a counterweight 180 and at the other end to the respective ends of the housing 168 on the carriage 4 by way of clamp screw and washer assemblies 182. The counterweight 180 is supported by two pairs of rollers 181 with concave rims riding in the tracks 156R, 156L. These rollers 181 are mounted in the ends of a pair of shafts 183 extending through the counterweight 180 and provided with suitable bearings housed in the counterweight.

The top end plate 172 in the center rail R-3 has a central extension **172*a* which overlaps the central leg 184*a* of the generally T-shaped frame of a guide carriage unit 184 and is connected thereto by an alignment pin 185 passing through suitable bushings in the extension 172*a* and leg 184*a*. A compression spring 186 is sleeved on the pin 185 between the head of the pin and the extension 172*a*. The pin 185 is retained by a snap ring 187 on the other end thereof separated from the underside of the leg 184*a*** by a washer.

Along its top edge, the top rail R-1 is formed with a central extension 188 formed with a concave longitudinal seat for receiving a top shaft 190 extending the length of the top rail. The shaft 190 is screw-mounted in position and passes through a pair of open-type ball bushings 191 housed in the frame arms **184*b* of the T-shaped guide unit 184. These arms have splits 184*c* and adjustment screws 192 extending therethrough to eliminate play between the bushings 191 and the top shaft 190**.

Figure 17:
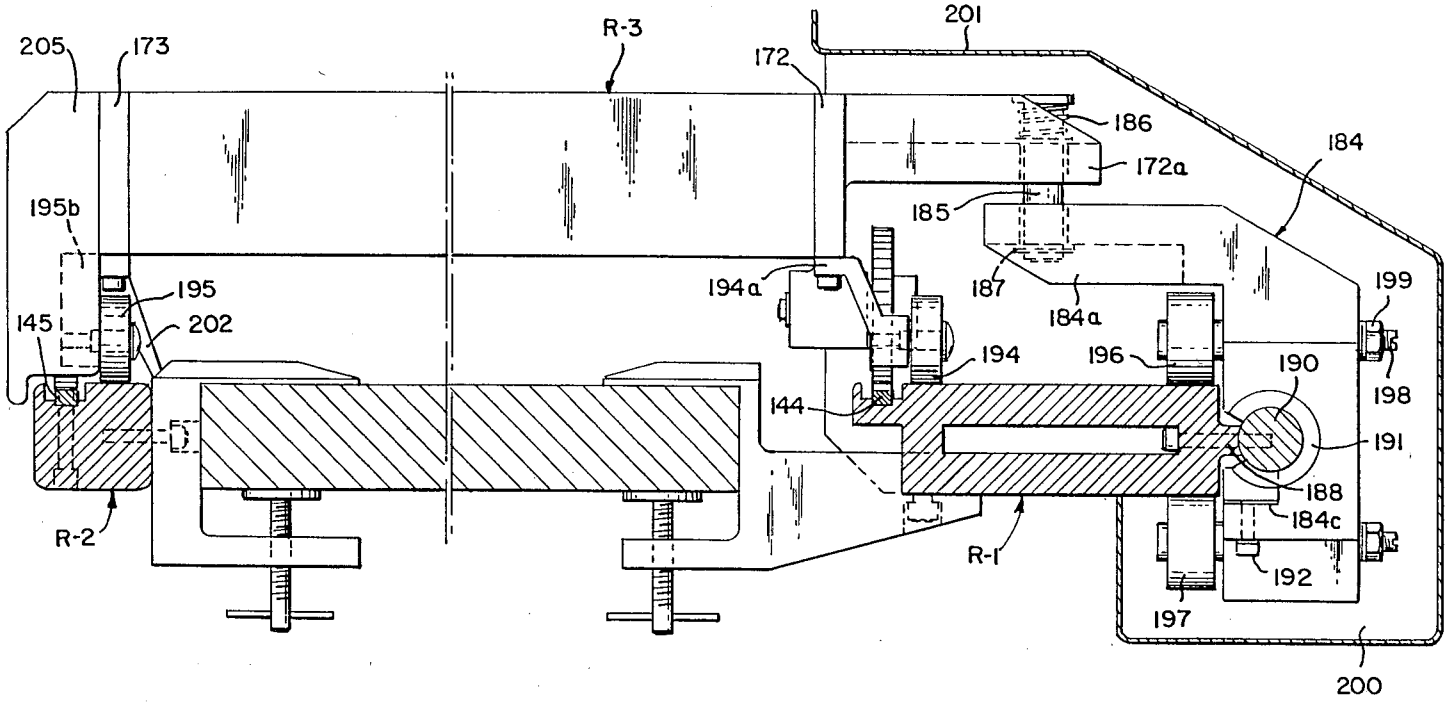
FIG. 17 is a fragmentary vertical sectional view taken as indicated by line 17—17 in FIG. 1.

To the right of its longitudinal center line, the center rail R-3 also is provided with top and bottom guide wheels 194, 195 journal-mounted on respective brackets 194*a*, 195*b*, in turn mounted on the underside of the end plates 172, 173, as shown in FIG. 17. These wheels 194, 195, track on the top and bottom rails in spaced, parallel relation to their racks 144, 145.

To keep the guide carriage unit 184 from turning relative to the top shaft 190, a pair of adjustable rollers 196, 197 are provided to engage the upper and lower faces of the top rail R-1. These rollers are journaled on eccentric shafts 198 passing centrally through the top of the housing of the guide carriage unit 184 to receive lock nuts and washers 199. By this arrangement, play can be eliminated between the rollers 196, 197 and the top rail R-1.

End plates 200 are preferably provided on the ends of the top rail R-1, and these are shaped to project outwardly, upwardly and rearwardly relative to the top rail to support a top sheet metal cover plate 201 so as to hide the top rail, guide carriage unit 184, and upper end portion of the center rail assembly.

Figure 19:
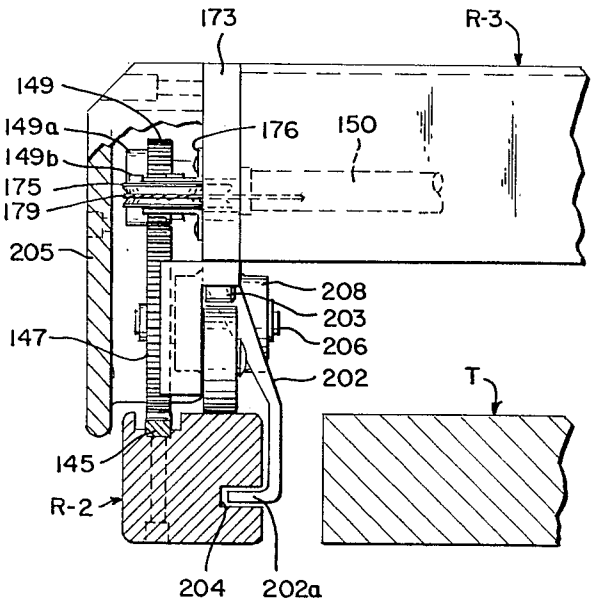
FIG. 19 is a fragmentary side elevational view, partly in vertical section, taken as shown by line 19—19 in FIG. 18.
Figure 18:
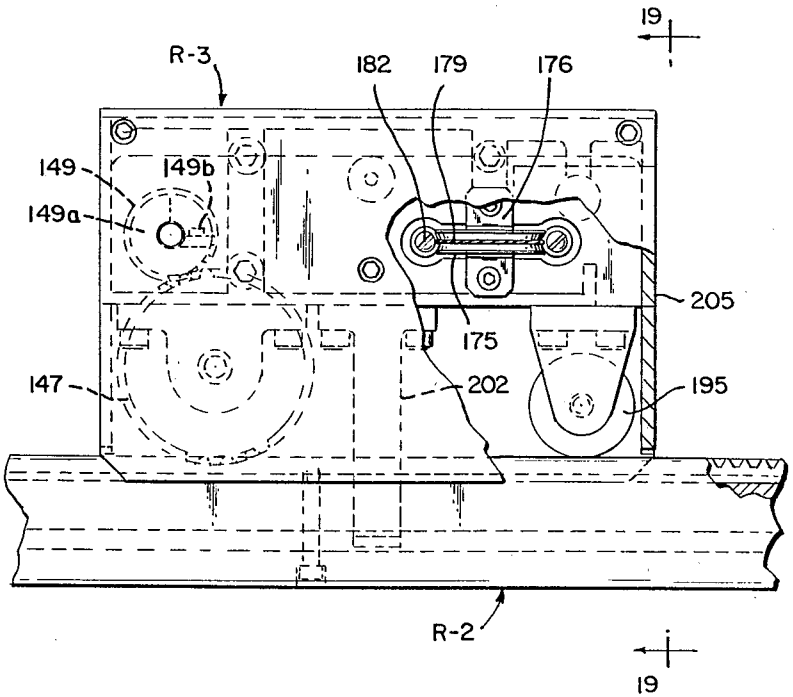
FIG. 18 is an elevational view of the bottom end of the center rail assembly and a related portion of the bottom rail.

Directing attention to the bottom end of the center rail R-3 (FIG. 19), it is seen that the end plate 173 has a keeper arm 202 bolted to its underside at 203. This keeper arm extends into the gap between the bottom edge of the drafting table T and the bottom rail R-2 and then bends outwardly to present a keeper finger 202*a* projecting into a groove 204 extending along the bottom rail to keep the lower end of the center rail from being lifted out of proper position.

A cover plate 205 is screw-connected to the bottom end plate 173 to cover the gears 147, 149 and the guide wheel 195 and to slightly overlap the bottom rail R-2. The gear 147 is mounted on a stub shaft 206 which is journaled in a pair of bearings housed in a bearing block 208. This block depends from the lower edge of the end plate 173 to which it is screw-connected. The hub 149*a* of the gear 149 is preferably split so that the gear can be turned relative to the shaft 150 until the center rail R-3 is perfectly perpendicular to the top and bottom rails. Then the screw 149*b* on the split hub of gear 149 is tightened to clamp the hub on the shaft and thereby lock the position of the gears 148, 149 relative to one another. This arrangement makes it possible to readily adjust for slight variances in vertical alignment of the teeth of the top rack 144 with the corresponding teeth of the bottom rack 145.

Returning to the adjusting mechanism 80*a*, it will be noted that it includes a spur gear 82*a* meshing with a central gear 210 on the shaft 150. This gear is mounted between a pair of bearing blocks 212, 213 (FIG. 14) mounted on the center rail to provide additional bearing support for the shaft 150. Preferably, antifriction washers are fitted between the bearing blocks and the gear 210 to eliminate endwise play in the shaft 150 relative to the center rail. Except for the external shape of its outer housing 214 and the fact that this housing is stationary relative to the center rail R-3, the adjusting mechanism 80*a* is the same as the adjusting mechanism 80 illustrated in FIG. 8. Accordingly, the suffix "a" has been applied to the parts of the adjusting mechanism 80*a* which correspond to those of adjusting mechanism 80. When the adjustment knob 86*a* is swung to the left, as viewed in FIGS. 1 and 15, it swings the gear 82*a* out of mesh with the gear 210 on the shaft 150. This has the effect of disconnecting the adjusting mechanism 80*a* from the top and bottom racks 144, 145 so that the center rail R-3 can then be moved freely left or right over the drafting table. While this is being done, the top and bottom idler gear 146, 147 remain synchronized via the gears 148, 149 and the shaft 150 so that the center rail R-3 always is kept perpendicular to the top and bottom rails. When the adjustment knob 86*a* is then released and swung back to the right by the spring 100*a*, bringing the gear 82*a* back into mesh with the gear 210 on the shaft 150, turning of the knob 86*a* will give a fine adjustment of the center rail R-3 on the X-axis, thereby giving a fine adjustment of the entire straight edge assembly 20 on the X-axis.

Figure 15:
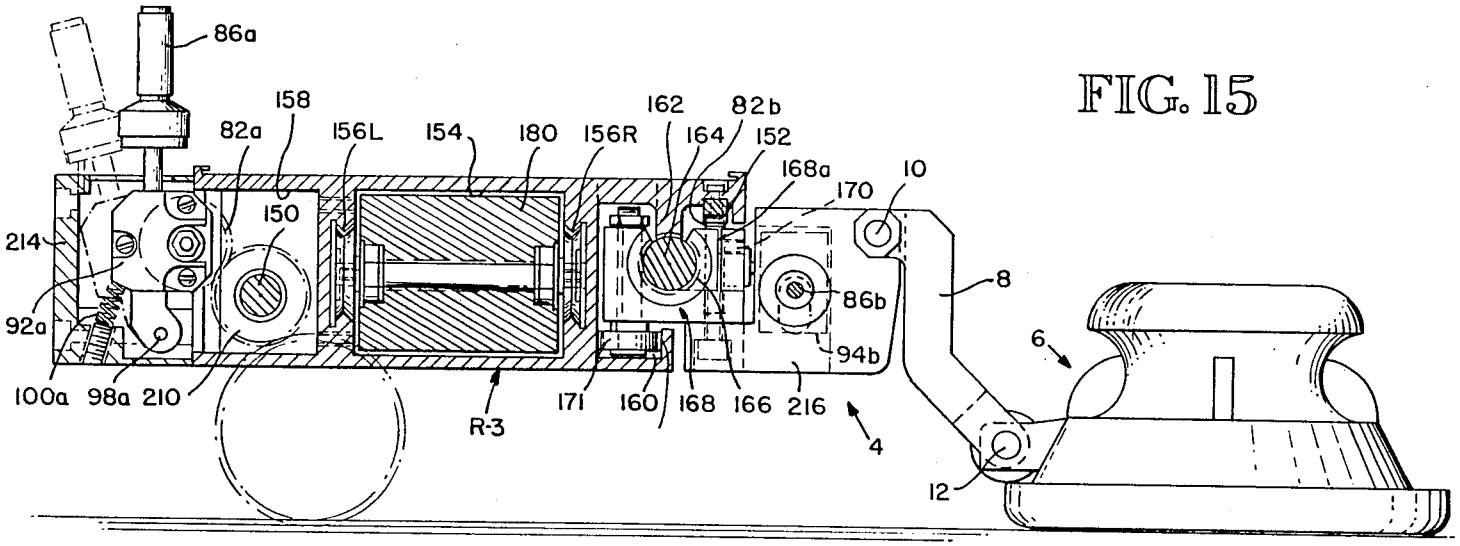
FIG. 15 is a transverse cross-sectional view of the center rail assembly taken as indicated by line 15—15 in FIG. 1.
Figure 16:
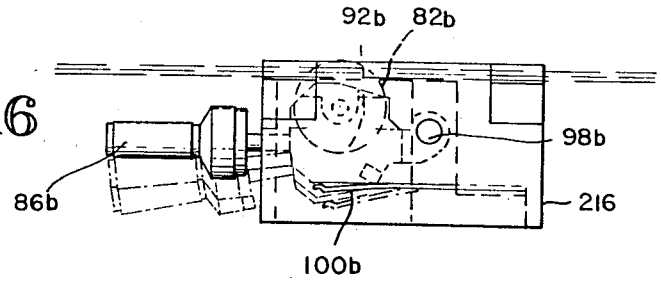
FIG. 16 is a side elevational view of the fine adjustment mechanism at the right side of the center rail without the pivot link connected.

Directing attention to FIGS. 15–16 and the adjusting mechanism 86*b* at the right side of the center rail R-3, such is basically the same as the adjusting mechanism 80 illustrated in FIG. 8 except for the external shape of the housing 216 and the fact that a leaf spring 100*b* is used for biasing rather than the coil spring 100. The suffix "b" has been applied to the parts of the adjusting mechanism 80*b* which correspond to those of adjusting mechanism 80. The leaf spring 100*b* bears against the underside of the frame member 94*b* to bias the adjustment knob 86*b* in an upward direction away from the working surface of the drafting table to urge the spur gear 82*b* into mesh with the rack 152 extending along the center rail R-3. When the adjustment knob 82*b* is pushed downwardly the gear 82*b* is disengaged from the rack 152 and the straight edge assembly 200 is then free to be moved along the center rail to the desired location on the Y-axis. Then the knob 82*b* is released to remesh the gear 82*b* with the rack 152 by action of the leaf spring 100*b*. Turning of the knob 86*b* will then give a fine adjustment of the straight edge assembly on the Y-axis.

It will be noted that by reference to FIG. 16 that the pivot 98*b* for the adjusting mechanism operated by the knob 86*b* is located such that when the table T is in a tilted position, the weight of the protractor head 6 and straight edge assembly 20 acts in cooperation with the leaf spring 100*b* to urge the gear 82*b* into engagement with the rack 152. Similarly, the gear 82 of the adjusting mechanism on the vertical mounting bar 30 is urged into engagement with the rack 84 therealong by the weight of the rest of the straight edge assembly as well as by the spring 100 when the drafting table is in tilted position.

I claim:

1. A drafting machine for use with a drafting table having a drawing surface, which comprises:

a protractor head adapted to be movably mounted on a drafting table such as to permit horizontal and vertical movement of the protractor head along the drawing surface of the drafting table;

an elongated first mounting means rotatably mounted on the protractor head and having an elongated first reference scale, the longitudinal axis of the first reference scale being parallel to the longitudinal axis of the first mounting bar;

an elongated second mounting means slidably mounted on the first mounting means with the longitudinal axis of the second mounting means being perpendicular to the longitudinal axis of the first mounting means, the second mounting means having an elongated second reference scale, the longitudinal axis of the second reference scale being parallel to the longitudinal axis of the second mounting means;

first and second elongated straight edges, said first straight edge being slidably mounted with respect to the second mounting means and the second straight edge, the longitudinal axis of the first straight edge being parallel to the first mounting means and being perpendicular to the longitudinal axis of the second mounting means and to the second straight edge, the first straight edge being alignable with the reference scale of the second mounting means;

said second straight edge being mounted on the second mounting means so as to be slidably mounted with respect to the first mounting means, the longitudinal axis of the second straight edge being perpendicular to the longitudinal axis of the first mounting means, the second straight edge being alignable with the first reference scale;

top, bottom, and center rails, each having a respective rack therealong;

first mounting means for mounting the top and bottom rails on the drafting table in parallel spaced relation;

second mounting means for mounting the center rail on the top and bottom rails for movement therealong with the center rail perpendicular to the top and bottom rails;

a carriage guided along the center rail and carrying said protractor head;

first adjusting means on the carriage normally arranged to operate with the rack on the center rail for finely adjusting and setting the position of the carriage lengthwise of the center rail;

second adjusting means on the center rail normally arranged to operate with the racks on the top and bottom rails simultaneously for finely adjusting and setting the position of the center rail lengthwise of the top and bottom rails;

first and second deactivating means for selectively deactivating said first and second adjusting means, respectively; and first and second biasing means opposing deactivation by said deactivating means, said center rail being adapted to be moved freely along the top and bottom rails when the second adjusting means is deactivated, and said carriage being adapted to be moved freely along the center rail when the first adjusting means is deactivated.

2. In combination:

top, bottom and center rails, the top and bottom rails each having a respective rack therealong;

first mounting means for mounting the top and bottom rails on a table in parallel spaced relation;

second mounting means for mounting the center rail on the top and bottom rails for movement therealong with the center rail perpendicular to the top and bottom rails;

adjusting means on the center rail normally arranged to operate with the racks on the top and bottom rails simultaneously for finely adjusting and setting the position of the center rail lengthwise of the top and bottom rails;

deactivating means for selectively deactivating said adjusting means; and biasing means opposing deactivation by said deactivating means; said center rail being adapted to be moved freely along the top and bottom rails when the adjusting means is deactivated.

3. A combination according to claim 2 in which said adjusting means comprises:

a first pair of gears on the ends of the center rail meshing with the racks on the top and bottom rails;

a shaft mounted on and extending along the center rail;

a second pair of gears on the ends of said shaft and meshing with said first pair of gears;

a central gear on said shaft;

a pinion normally meshing with said central gear;

a worm gear driving the pinion ; and a worm meshing with the worm gear;

said deactivating means being adapted to swing the pinion, worm gear, and worm as a unit out of mesh with the central gear.

4. A combination according to claim 2 in which a carriage is guided along the center rail, and in which second adjusting means are provided for determining the position of the carriage relative to the length of the center rail.

5. A combination according to claim 4 in which said carriage carries a protractor head and the protractor head in turn carries a straight edge assembly.

6. In combination:

top, bottom and center rails, each having a respective rack therealong;

first mounting means for mounting the top and bottom rails on a table in parallel spaced relation;

second mounting means for mounting the center rail on the top and bottom rails for movement therealong with the center rail perpendicular to the top an bottom rails;

a carriage guided along the center rail;

first adjusting means on the carriage normally arranged to operate with the rack on the center rail for finely adjusting and setting the position of the carriage lengthwise of the center rail;

second adjusting means on the center rail normally arranged to operate with the racks on the top and bottom rails simultaneously for finely adjusting and setting the position of the center rail lengthwise of the top and bottom rails;

first and second deactivating means for selectively deactivating said first and second adjusting means, respectively; and first and second biasing means opposing deactivation by said deactivating means; said center rail being adapted to be moved freely along the top and bottom rails when the second adjusting means is deactivated, and said carriage being adapted to be moved freely along the center rail when the first adjusting means is deactivated.

7. A combination according to claim 6 in which an adjustable protractor head is swing-mounted on said carriage, and a straight edge assembly is carried by the protractor head.

8. A combination according to claim 6 in which said first adjusting means is swing-mounted about a swing axis to move between an active position operating with the rack on the center rail and a deactivated position, said swing axis being located such as to cause the first adjusting means to swing by gravity into active position when the table is tilted.

9. A combination according to claim 6 in which counterweight means is slide-mounted on said center rail and is operatively connected to said carriage to resist movement of the carriage toward the bottom rail.

* * * * *